US008029081B2

(12) United States Patent
Oh

(10) Patent No.: US 8,029,081 B2
(45) Date of Patent: Oct. 4, 2011

(54) REFRIGERATOR

(75) Inventor: Kyong Sok Oh, Changwon-si (KR)

(73) Assignee: LG Electronics Inc., Seoul (KR)

( * ) Notice: Subject to any disclaimer, the term of this patent is extended or adjusted under 35 U.S.C. 154(b) by 626 days.

(21) Appl. No.: 12/142,559

(22) Filed: Jun. 19, 2008

(65) Prior Publication Data

US 2008/0315743 A1 Dec. 25, 2008

(30) Foreign Application Priority Data

Jun. 20, 2007 (KR) ..... 10-2007-0060268

(51) Int. Cl.
*A47B 96/04* (2006.01)

(52) U.S. Cl. ..... 312/402; 312/334.7

(58) Field of Classification Search ..... 312/402, 312/334.7, 334.8, 334.4, 334.5, 334.1, 350, 312/349, 408, 410, 404; 384/22; 248/424, 248/429, 430, 225.21
See application file for complete search history.

(56) References Cited

U.S. PATENT DOCUMENTS 2,907,539 A * 10/1959 Vardan ..... 248/104
3,006,710 A * 10/1961 Petkwitz ..... 312/311
3,094,363 A * 6/1963 Gorton et al. ..... 312/334.4
3,210,143 A * 10/1965 Frederick ..... 312/281
3,744,869 A * 7/1973 Anderson et al. ..... 312/348.1
4,140,356 A * 2/1979 Chervanak ..... 312/350
4,147,393 A * 4/1979 Nelson et al. ..... 384/22
4,320,935 A * 3/1982 Nagelkirk ..... 312/350
4,440,461 A * 4/1984 Powell et al. ..... 312/334.8
5,025,545 A * 6/1991 Brown ..... 29/434
5,209,572 A * 5/1993 Jordan ..... 384/18
6,076,908 A * 6/2000 Maffeo ..... 312/334.7
6,123,402 A * 9/2000 Bowyer et al. ..... 312/334.7
6,923,519 B2 * 8/2005 Dallman et al. ..... 312/408
2003/0173882 A1 * 9/2003 Koons ..... 312/404
2004/0164654 A1 * 8/2004 Laible ..... 312/122
2006/0022564 A1 * 2/2006 Oh et al. ..... 312/402
2007/0035221 A1 * 2/2007 Koo ..... 312/404
2007/0085457 A1 * 4/2007 Park et al. ..... 312/402
2007/0228911 A1 * 10/2007 Kim et al. ..... 312/408
2009/0058248 A1 * 3/2009 Gossens et al. ..... 312/408

* cited by examiner

*Primary Examiner* — Darnell Jayne
*Assistant Examiner* — Andres F Gallego
(74) *Attorney, Agent, or Firm* — Birch, Stewart, Kolasch & Birch, LLP

(57) ABSTRACT

A refrigerator can prevent torsion of a rail member guiding withdrawal of a storage box to stably withdraw the storage box. The refrigerator includes a body, a movable storage box, a rail member, and a supporting member. The body includes a storing compartment. The movable storage box is provided inside the body. The rail member is provided in at least one side of the storage box and guides a movement of the storage box. The supporting member is disposed between the rail member and the body and allows the rail member to be tiltably supported with respect to the body. Therefore, the usability of the refrigerator is improved.

14 Claims, 3 Drawing Sheets

REFRIGERATOR

CROSS-REFERENCE TO RELATED APPLICATIONS

The present application claims priority under 35 U.S.C. 119 and 35 U.S.C. 365 to Korean Patent Application No. 10-2007-0060268 filed on Jun. 20, 2007), which is hereby incorporated by reference in its entirety.

BACKGROUND

Embodiments relate to a refrigerator, and more particularly, to a refrigerator in which torsion of a rail member guiding a movement of a storage box is prevented to stably insert or withdraw the storage box.

In general, a refrigerator is equipment for storing goods at a lower temperature. The refrigerator is configured to store foods in a freezing or refrigerating state according to the foods to be stored therein.

The inside of the refrigerator is refrigerated by cold air continuously produced by heat exchange with refrigerant. The refrigerant circulates in the refrigerator while undergoing a continuous refrigeration cycle of compression, condensation, expansion, and evaporation.

Thus, the cold air flowing inside the refrigerator is uniformly distributed into the refrigerator by convection, thereby allowing foods in the refrigerator to be stored at a desired temperature.

With the tendency of large-scaled and multifunctional refrigerators according to a variety of user preferences and changes in eating patterns, various types of refrigerators are being released.

Such a refrigerator is classified into three types according to relative position between a refrigerator compartment and a freezer compartment. In a first type, the freezer compartment is disposed above the refrigerator compartment. In a second type, the freezer compartment is disposed under the refrigerator compartment. In a third type, the freezer compartment and the refrigerator compartment are adjacently disposed with respect to each other at the left and right sides.

Although a bottom freezer type in which a freezer compartment is disposed under a refrigerator compartment will be described as an example in an embodiment, the present disclosure is not limited thereto but can be applied to various products.

In the bottom freezer type, a withdrawable storage box is provided in the freezer compartment of a refrigerator. The storage box is coupled to a freezer compartment door. The storage box is withdrawn when the freezer compartment door opens.

A guide rail guiding insertion and withdrawal of the storage box is provided on both sides of the storage box. A portion of the guide rail, i.e., a rear end of the guide rail is fixed to a lateral surface of the freezer compartment, the other portion of the guide rail, i.e., a front end of the guide rail is withdrawn in stages.

However, the related art refrigerator as described above has a limitation as mentioned in the following sections.

When the storage box is withdrawn, a force acting in a downward direction is applied to the storage box due to a load of stored goods. In this case, one side of the rail supporting the storage box is torsioned with respect to the other side of the rail.

That is, since the rear end of the rail is fixed to the lateral surface of the freezer compartment, the rear end of the rail is slightly torsioned. On the other hand, the withdrawn front end of the rail is relatively sharply torsioned.

Therefore, when the storage box is repeatedly inserted and withdrawn, or when the storage box is maintained in a withdrawn state for a long time, the rail is plastic-deformed to cause malfunction.

In addition, when the freezer compartment does not completely close due to breakdown of the rail, the refrigerator cannot perform its normal function.

SUMMARY

Embodiments provide a refrigerator in which a tiltable rail member guiding a movement of a storage box can be provided to prevent the rail member from being torsioned.

Embodiments also provide a refrigerator in which torsion of a rail member can be prevented to easily insert and withdraw a storage box.

Embodiments also provide a refrigerator in which breakdown of a rail member can be minimized even if a storage box is repeatedly inserted and withdrawn.

In one embodiment, A refrigerator includes a body including a storing compartment; a movable storage box inside the body; a rail member in at least one side of the storage box, the rail member guiding a movement of the storage box; and a supporting member between the rail member and the body, the supporting member allowing the rail member to be tiltably supported with respect to the body.

In another embodiment, A refrigerator includes A refrigerator includes a body including a storing compartment; a withdrawable storage box inside the body; a rail member in at least one side of the storage box, the rail member guiding a withdrawal of the storage box; and a supporting member allowing the rail member to be supported with respect to the body, wherein the rail member is tilted in one direction when the storage box is withdrawn.

In another embodiment, A refrigerator includes a body including a storing compartment; a withdrawable storage box inside the body; a rail member in at least one side of the storage box, the rail member guiding a withdrawal of the storage box; and a supporting member allowing the rail member to be supported with respect to the body, wherein the rail member comprises: a rail bracket tiltably supported with respect to the supporting member; and a withdrawal rail received into the rail bracket, the withdrawal rail being withdrawn from the rail bracket.

The details of one or more embodiments are set forth in the accompanying drawings and the description below. Other features will be apparent from the description and drawings, and from the claims.

DETAILED DESCRIPTION OF THE EMBODIMENTS

Hereinafter, reference will be now made in detail to the embodiments, examples of which are illustrated in the accompanying drawings. However, it should be understood that the spirit and scope of the principles of this disclosure will not be limited to embodiments provided herein, and that alternate embodiments included in other retrogressive inventions or falling within the spirit and scope of the present disclosure can easily be derived through adding, altering, or deleting other elements.

Figure 1:
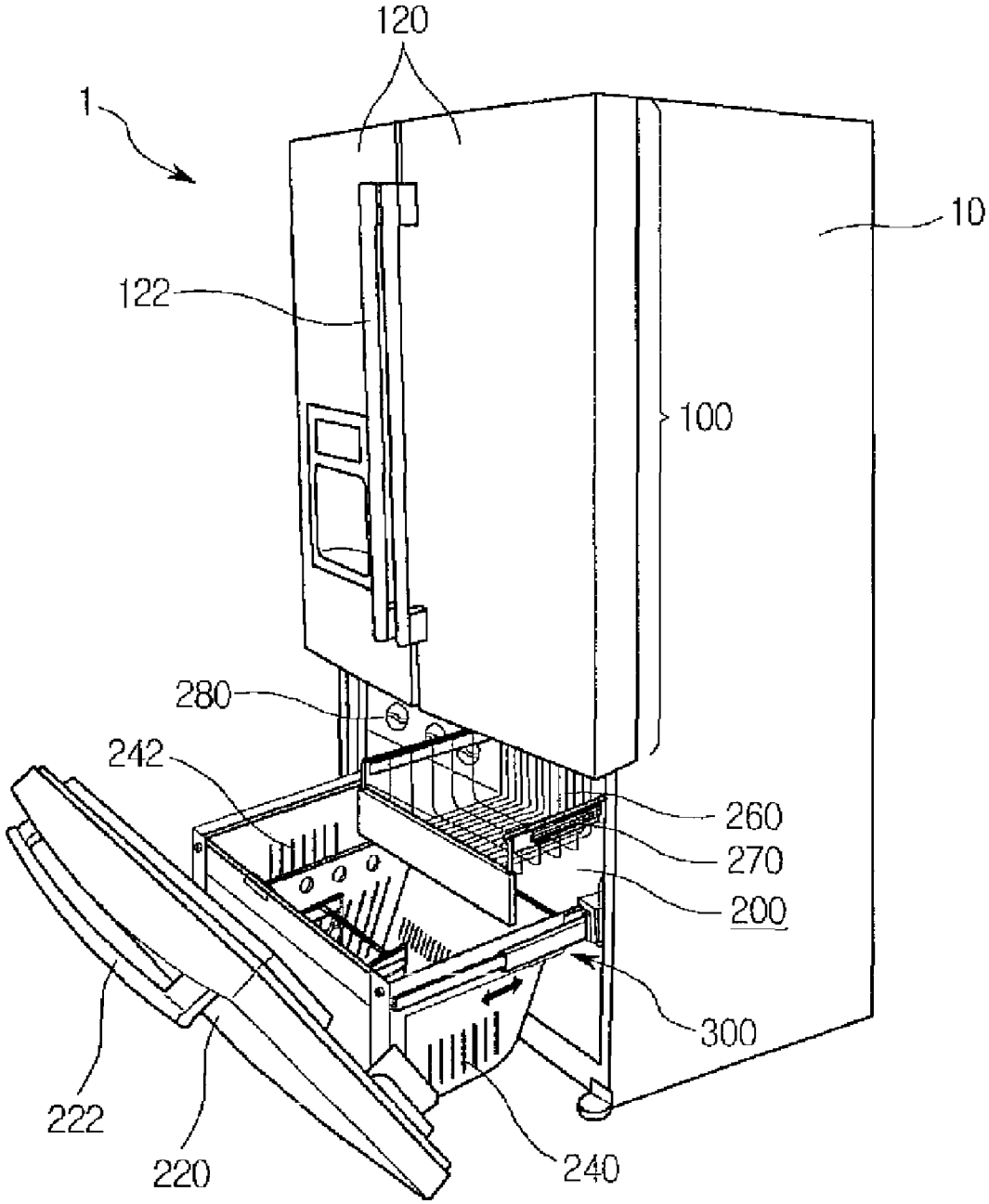
FIG. 1 is a perspective view of a refrigerator in which a freezer compartment door opens according to an embodiment.

FIG. 1 is a perspective view of a refrigerator in which a freezer compartment door opens according to an embodiment.

Referring to FIG. 1, a refrigerator 1 according to an embodiment includes a body 10 defining an outer appearance and doors 120 and 220 pivotally coupled to an opened front surface of the body 10.

The body 10 has a rectangular parallelepiped shape, and a storing compartment for storing foods is disposed inside the body 10. The storing compartment includes a refrigerator compartment 100 and a freezer compartment 200. The refrigerator compartment 100 is disposed inside an upper portion of the body 10 and stores the foods in a refrigerating state. The freezer compartment 200 is disposed inside a lower portion of the body 10 and stores the foods in a freezing state. A barrier (not shown) separates the refrigerator compartment 100 from the freezer compartment 200.

Although not shown, a plurality of drawers and shelves for adequately storing various foods are provided inside the refrigerator compartment 100.

A front surface of the refrigerator compartment 100 opens, and a refrigerator compartment door 120 pivotally coupled to the body 10 is provided in a front direction of the refrigerator compartment 100. A plurality of doors 120 is provided at left and right sides, respectively, to selectively shield the refrigerator compartment 100.

A refrigerator compartment door handle 122 capable of being grasped by a user is provided on a front surface of the refrigerator compartment door 120 in order to open and close the refrigerator compartment door 120.

A freezer compartment 200 for storing the foods in the freezing state is disposed inside the lower portion of the body 10.

A front surface of the freezer compartment 200 opens, and a freezer compartment door 220 withdrawable coupled to the body 10 is provided in a front direction of the freezer compartment 200. The freezer compartment door 220 selectively shields the freezer compartment 200.

A freezer compartment door handle 222 capable of being grasped by the user is provided on a front surface of the freezer compartment door 220 in order to open and close the freezer compartment door 220.

An ice maker 280 for making an ice is provided in an upper portion of the freezer compartment 200.

A drawer 260 for receiving small-sized foods is provided in a side of the ice maker 280. A withdrawal rail 270 for guiding a movement of the drawer 260 is provided in at least one side of the drawer 260. The drawer 260 may be withdrawn toward the front direction of the freezer compartment 200 by the withdrawal rail 270.

A storage box 240 is provided inside the freezer compartment door 220. The storage box may be moved with the freezer compartment door 220 at the same time when the freezer compartment door 220 is inserted and withdrawn.

The storage box 240 receives large-sized foods and may be formed of a plastic or wire material. The storage box 240 is detachably coupled to the freezer compartment door 220.

The storage box 240 has a size corresponding to a size (width) of an inner space of the freezer compartment 200. An upper surface of the storage box 240 opens, and the foods may be put into and out of the storage box 240 through the opened upper surface.

A barrier 242 dividing an inner space of the storage box 240 is provided inside the storage box 240. The barrier 242 may be moved in left and right directions, and the divided space of the storage box 240 may be adjusted by moving the barrier 242.

A rail member 300 guiding insertion and withdrawal of the storage box 240 is provided on both sides of the storage box 240. The rail member 300 may be attached to a surface of a wall of the body 10, i.e., an inner surface of the freezer compartment 200 by a supporting member (See reference numeral 400 of FIG. 3).

Configurations of the rail member 300 and the supporting member 400 and a coupling relation between the rail member 300 and the supporting member 400 will now be described with reference to FIGS. 2 and 3.

Figure 2:
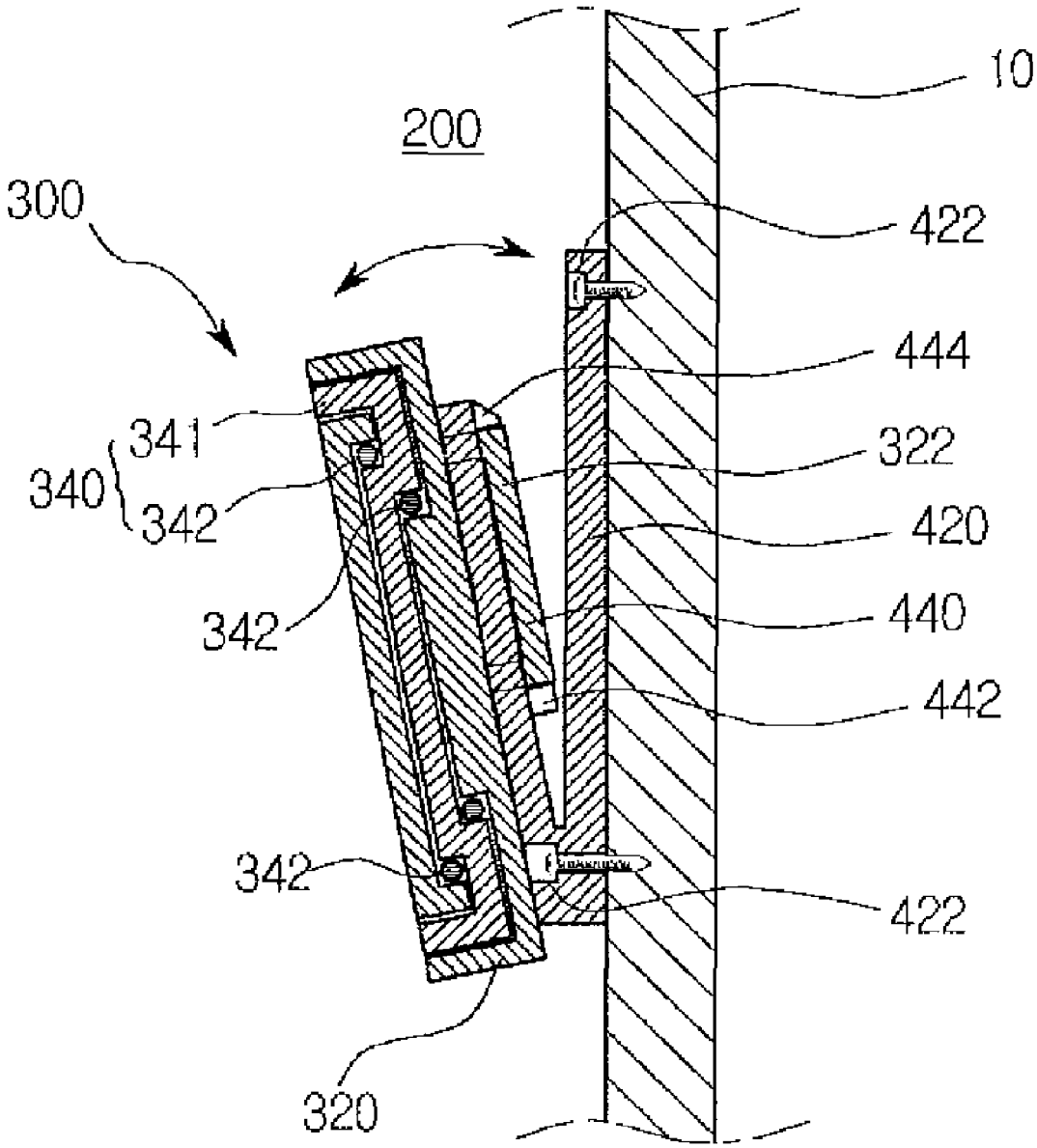
FIG. 2 is a cross-sectional view illustrating a coupling relation between a rail member and a supporting member according to an embodiment.
Figure 3:
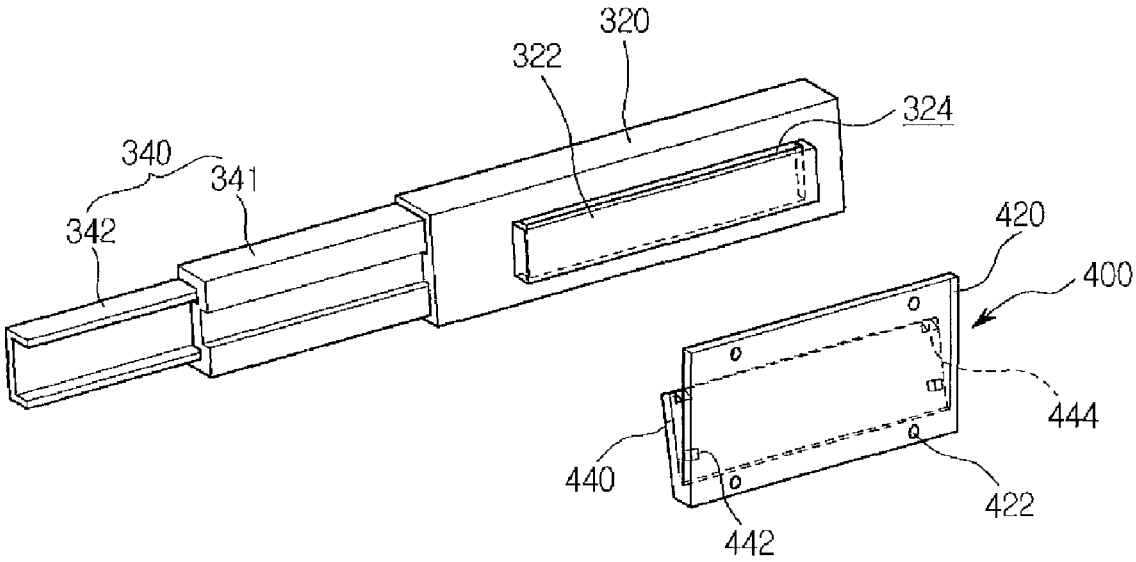
FIG. 3 is an exploded perspective view of a rail member and a supporting member according to an embodiment.

FIG. 2 is a cross-sectional view illustrating a coupling relation between a rail member and a supporting member according to an embodiment, and FIG. 3 is an exploded perspective view of a rail member and a supporting member according to an embodiment.

Referring to FIGS. 2 and 3, a refrigerator 1 according to an embodiment includes a rail member 300 guiding a movement of a storage box 240 and a supporting member 400 supporting the rail member 300 to a body 10.

In detail, the rail member 300 is coupled to both sides of the storage box 240.

The rail member 300 includes a withdrawal rail 340 and a rail bracket 320. The withdrawal rail 340 is withdrawn in a front direction of a freezer compartment 200. The rail bracket 320 receives the withdrawal rail 340 therein and is supported by the supporting member 400.

The withdrawal rail 340 is disposed horizontally in front and rear directions of the freezer compartment 200.

The withdrawal rail 340 includes a first withdrawal rail 341 and a second withdrawal rail 342 which are withdrawable in the front direction of the freezer compartment 200.

The second withdrawal rail 342 is received into the first withdrawal rail 341.

When the withdrawal rail 340 is withdrawn in the font direction of the freezer compartment 200, the first withdrawal rail 341 is withdrawn from the rail bracket 320, and the second withdrawal rail 342 is withdrawn from the first withdrawal rail 341.

The withdrawal rail 340 is withdrawn from the rail bracket 320 in stages to extend a length thereof.

A plurality of withdrawal rails in addition to the first and second withdrawal rails 341 and 342 may be provided according to the withdrawn length of the withdrawal rail 340 and a quantity of a load applied from the storage box 240 to the withdrawal rail 340.

A plurality of coupling projections (not shown) coupled to the storage box 240 is disposed on the withdrawal rail 340. A side of the storage box 240 is fitted/fixed to the withdrawal rail 340 by the coupling projections.

A plurality of bearings 342 is provided in the withdrawal rail 340 so that the withdrawal rail 340 is easily withdrawn. The bearings 342 are provided between the rail bracket 320 and the first withdrawal rail 341 and between the first withdrawal rail 341 and the second withdrawal rail 342. Each of the bearings has a ball shape having a predetermined diameter.

The rail bracket 320 has an approximately "ㄷ"shape in side cross-section. The rail bracket 320 has one side surface including an open surface through which the withdrawal rail 340 can be withdrawn and the other side surface including a shield surface supported by the supporting member 400.

A protrusion 322 protruding toward the supporting member 400 is provided on a surface in which the rail bracket 320 does not open, i.e., a front surface (when viewed in FIG. 3). A coupling slot 324 inserting the supporting member 400 therein is formed in the protrusion 322.

A cover (not shown) receiving the rail member 300 therein may be provided on an upper side of the rail bracket 320.

Appearance of the rail member 300 may be fine due to the cover.

The supporting member 400 tiltably supporting the rail member 300 is provided between the rail member 300 and the body 10. The supporting member 400 is coupled to an inner surface of the body 10. The rail member 300 can be inserted into the supporting member 400.

The supporting member 400 includes a coupling portion 420 and a support 440. The coupling portion 420 is coupled to the surface of the wall of the freezer compartment 200. The support 440 extends from a lower end of the coupling portion 420 in upward direction and is inserted into the coupling slot 324 of the rail member 300.

The coupling portion 420 includes a coupling surface having a rectangular shape. The coupling surface is coupled to the body 10.

A plurality of coupling holes through which a coupling member (not shown) passes is formed in the coupling portion 420. Since the coupling portion 420 is coupled to the body 10 by the coupling member, the supporting member 400 is fixed to the body 10.

The support 440 inclinedly extends from the lower end of the coupling portion 420 in the upward direction. The support 440 may be welded to the lower end of the coupling portion 420 or bent from the coupling portion 420 in an upward direction.

The support 440 may have a predetermined elasticity such that the rail member 300 can be easily tilted.

When the storage box 240 is withdrawn from the body 10, the support 440 is elastic-deformed in a direction spaced apart from the coupling portion 420. On the other hand, when the storage box 240 is inserted into the body 10, the support 440 is elastic-deformed in a direction of the coupling portion 420.

In a state where the support 440 is inserted into the coupling slot 324, i.e., the support 440 supports the rail bracket 320, a stop projection 442 supporting a lower portion of the protrusion 322 is provided.

The stop projection 442 is disposed at a position corresponding to a lower end of the protrusion 322. In a state where the support 44 is inserted into the coupling slot 324, the stop projection 442 interferes with the lower end of the protrusion 322 to limit an insertion depth of the protrusion 322.

The stop projection 422 sets a lower limitation of the rail bracket 320 supported by the supporting member 400. A plurality of stop projections 442 may be provided on both sides of support 440.

A hooking projection 444 is provided on an upper portion of the support 440. The hooking projection 444 supports an upper portion of the protrusion 322 in a state where the rail bracket 320 is supported by the support 440.

In a state where the support 440 is inserted into the coupling slot 324, the hooking projection 444 interferes with an upper end of the protrusion 322 to prevent the rail bracket 320 from being separated from the coupling slot 324. The hooking projection 444 protrudes from the support 440 in a direction of the coupling portion 420, and a plurality of hooking projections may be provided. Thus, the hooking projection 444 is hooked on the upper end of the protrusion 322 to prevent the coupling portion 420 from being easily separated from the protrusion 322.

The hooking projection 444 may be elastic-deformed in upward and downward direction such that the support 440 is easily inserted and separated. When the support 440 is inserted into the coupling slot 324, the hooking projection 444 is depressed. When the support 440 is completely inserted, the hooking projection 444 protrudes due to a force of restoration.

An assembly and functions of the rail member 300 and the supporting member 400 according to this embodiment will now be described with reference to FIGS. 1 to 3.

A process in which the rail member 300 is coupled to the body 10 will be described below.

The coupling portion 420 of the supporting member 400 is closely fixed to the surface of the wall of the body 10, i.e., a sidewall of the freezer compartment 200 using the coupling member such as a screw. The coupling member passes through the coupling hole 422 to couple the coupling portion 420 to the body 10.

The support 440 of the supporting member 400 is inserted into the protrusion 322 of the rail member 300. The lower portion of the protrusion 322 is supported by the stop projection 442, and the upper portion of the protrusion 322 is supported by the hooking projection 444. Accordingly, the lower and upper portions of the protrusion 322 are stably supported. Therefore, the rail bracket 320 can be easily supported by the supporting member 400.

The rail member 300 is coupled to the both sides of the storage box 240 coupled to the freezer compartment door 220.

The functions of the rail member 300 and the supporting member 400 will now be described.

The user can withdraw the freezer compartment door 220 in the front direction in a state where the user grasps the freezer compartment door handle 222.

As a result, the storage box 240 coupled to the freezer compartment door 220 is withdrawn in the front direction. Here, the withdrawal rails 341 and 342 of the rail member 300 are withdrawn in the front direction of the freezer compartment. That is, the first withdrawal rail 341 is withdrawn from the rail bracket 320, and the second withdrawal rail 342 is withdrawn from the first withdrawal rail 341.

A force acting in an inward and downward of the storage box 240 is applied to the withdrawal rail 340 due to a load of the storage box 240.

As a result, a torsion phenomenon due to the force occurs in the withdrawal rail 340.

The rail member 300 is tilted in the inward and downward direction of the storage box 240 because of elastic deformation of the support 440. That is, the rail member 300 can be tilted in a direction in which the torsion phenomenon occurs due to the elastic deformable supporting member 400.

The force applied to the withdrawal rail 340 is transmitted to the supporting member 400 and compensated by the elastic deformation of the supporting member 400 to minimize the torsion phenomenon of the withdrawal rail 340.

When the storage box 240 is inserted into the body 10, the withdrawal rail 340 is received inside the rail bracket 320.

Thus, the force applied to the withdrawal rail 340 is reduced, and the support 440 is moved in a direction of the coupling portion 420 due to the force of restoration. Therefore, the freezer compartment door 220 closes in a state where the support 440 is adjacent to the rail bracket 320.

According to the embodiment, the rail member guiding the movement of the storage box can be tiltably coupled to the supporting member to minimize the torsion of the rail member when the storage box is withdrawn.

Accordingly, the storage box can be easily inserted and withdrawn to improve the usability.

In addition, since the torsion of the rail member can be prevented, the durability of the rail member increases to improve the reliability of products.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a body including a storing compartment;

a movable storage box inside the body;

a rail member in at least one side of the storage box, the rail member guiding a movement of the storage box; and a supporting member between the rail member and the body, the supporting member allowing the rail member to be tiltably supported with respect to the body, the supporting member comprising:

a coupling portion coupled to the body; and a support coupled to the rail member and configured to be movable in a direction away from the coupling portion; wherein the rail member comprises: a rail bracket tiltably supported with respect to the coupling portion, with the support being inserted into the rail bracket; and a withdrawal rail received in the rail bracket.

2. The refrigerator according to claim 1, wherein a plurality of withdrawal rails is provided.

3. The refrigerator according to claim 2, further comprising a bearing between the withdrawal rails to allow the withdrawal rails to be easily withdrawn.

4. The refrigerator according to claim 1, wherein the support comprises a stop projection setting a lower portion in a state where the rail member is supported by the supporting member.

5. The refrigerator according to claim 1, wherein the support comprises a hooking projection supporting an upper portion of the rail member in a state where the rail member is supported by the supporting member.

6. A refrigerator comprising:

a body including a storing compartment;

a withdrawable storage box inside the body;

a rail member in at least one side of the storage box, the rail member guiding a withdrawal of the storage box; and a supporting member coupled to the body and the rail member to allow the rail member to be supported with respect to the body, wherein the supporting member comprises: a coupling portion coupled to the body; and a support extending toward a side of the coupling portion;

wherein the rail member comprises:

a rail bracket tiltably supported with respect to the coupling portion, with the support being inserted into the rail bracket; and a withdrawal rail received into the rail bracket, the withdrawal rail being withdrawn from the rail bracket, and wherein the support is movable in a first direction when the storage box is withdrawn, and the at least one portion of the supporting member is movable in a second direction when the storage box is received into the body, the first direction opposed to the second direction.

7. The refrigerator according to claim 6, wherein the withdrawal rail comprises:

a first withdrawal rail received into the rail bracket; and a second withdrawal rail received into the first withdrawal rail.

8. The refrigerator according to claim 6, wherein the rail bracket comprises a protrusion inserting the support therein.

9. The refrigerator according to claim 6, wherein the support inclinedly extends from a lower end of the coupling portion in an upward direction.

10. The refrigerator according to claim 8, wherein the support comprises a projection supporting at least one of an upper portion and a lower portion of the protrusion.

11. The refrigerator according to claim 6, wherein the the support is elastically deformed when the storage box is withdrawn.

12. The refrigerator according to claim 6, wherein the supporting member is inserted into the rail member.

13. The refrigerator according to claim 11, wherein when the storage box is inserted into the body, and the rail member and the support are restored to their proper position when the storage box is inserted.

14. The refrigerator according to claim 6, wherein the rail member is withdrawn in stages when the storage box is withdrawn.

* * * * *